US011612987B1

(12) United States Patent
Williams

(10) Patent No.: US 11,612,987 B1
(45) Date of Patent: Mar. 28, 2023

(54) TOOL-LESS VISE JAW SYSTEM

(71) Applicant: Christopher Williams, St. Louis, MO (US)

(72) Inventor: Christopher Williams, St. Louis, MO (US)

( * ) Notice: Subject to any disclaimer, the term of this patent is extended or adjusted under 35 U.S.C. 154(b) by 13 days.

(21) Appl. No.: 17/373,833

(22) Filed: Jul. 13, 2021

(51) Int. Cl.
*B25B 1/24* (2006.01)
*B25B 1/02* (2006.01)

(52) U.S. Cl.
CPC ..... *B25B 1/2405* (2013.01); *B25B 1/02* (2013.01)

(58) Field of Classification Search
CPC ..... B25B 27/00; B25B 13/00; B25B 13/12; B25B 5/02; B25B 5/04; B25B 1/00; B25B 1/02; B25B 1/04; B25B 1/06; B25B 1/20; B25B 1/2405
USPC ..... 269/43, 45, 156, 246
See application file for complete search history.

(56) References Cited

U.S. PATENT DOCUMENTS 4,216,950 A 8/1980 Mason
4,243,213 A 1/1981 Georgian
4,986,519 A 1/1991 Lee
5,581,865 A * 12/1996 Will ..... B25B 27/28 29/426.6
D420,880 S 2/2000 Lavigne
6,672,578 B1 * 1/2004 Martens ..... B25B 1/2468 269/282
8,998,190 B2 4/2015 Winn
2006/0013648 A1 1/2006 Bernstein
2009/0020937 A1 * 1/2009 Odell ..... B25B 1/2468 269/271
2016/0052110 A1 * 2/2016 Erdman ..... B25B 27/00 29/271

FOREIGN PATENT DOCUMENTS

EP 1125690 1/2004

* cited by examiner

*Primary Examiner* — Lee D Wilson
*Assistant Examiner* — Sidney D Hohl
(74) *Attorney, Agent, or Firm* — Kyle A. Fletcher, Esq.

(57) ABSTRACT

The tool-less vise jaw system comprises a stop block and two jaw plates. The jaw plates couple to the jaws of a vise that is used in conjunction with an industrial machine or tool. One jaw plate comprises a plurality of holes into which pins projecting from the stop block may be inserted. One pin extends through the jaw plate into the space between the vise jaws. The pin is used as a reference point during edge finding. Later, when switching from one job to another, the stop block may be moved to a different position in the plurality of holes and a digital readout may be programmed to change an X-axis offset by an amount corresponding to the distance that the pin was moved, thus eliminating the need to edge find again.

17 Claims, 7 Drawing Sheets

TOOL-LESS VISE JAW SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of industrial tools, more specifically, a tool-less vise jaw system.

SUMMARY OF INVENTION

The tool-less vise jaw system comprises a stop block and two jaw plates. The jaw plates couple to the jaws of a vise that is used in conjunction with an industrial machine or tool.

One jaw plate comprises a plurality of holes into which pins projecting from the stop block may be inserted. One pin extends through the jaw plate into the space between the vise jaws. The pin is used as a reference point during edge finding. Later, when switching from one job to another, the stop block may be moved to a different position in the plurality of holes and a digital readout may be programmed to change an X-axis offset by an amount corresponding to the distance that the pin was moved, thus eliminating the need to edge find again.

An object of the invention is to provide a movable reference point for calibrating and industrial machine or tool.

Another object of the invention is to prevent edge finding when switching jobs by moving the reference point a known distance and reprogramming a DRO to indicate the new position of the reference point, A further object of the invention is to increase the height of a vise to allow taller nested workpieces to be processed.

These together with additional objects, features and advantages of the tool-less vise jaw system will be readily apparent to those of ordinary skill in the art upon reading the following detailed description of the presently preferred, but nonetheless illustrative, embodiments when taken in conjunction with the accompanying drawings.

In this respect, before explaining the current embodiments of the tool-less vise jaw system in detail, it is to be understood that the tool-less vise jaw system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the tool-less vise jaw system.

It is therefore important that the claims be regarded as including such equivalent construction insofar as they do not depart from the spirit and scope of the tool-less vise jaw system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
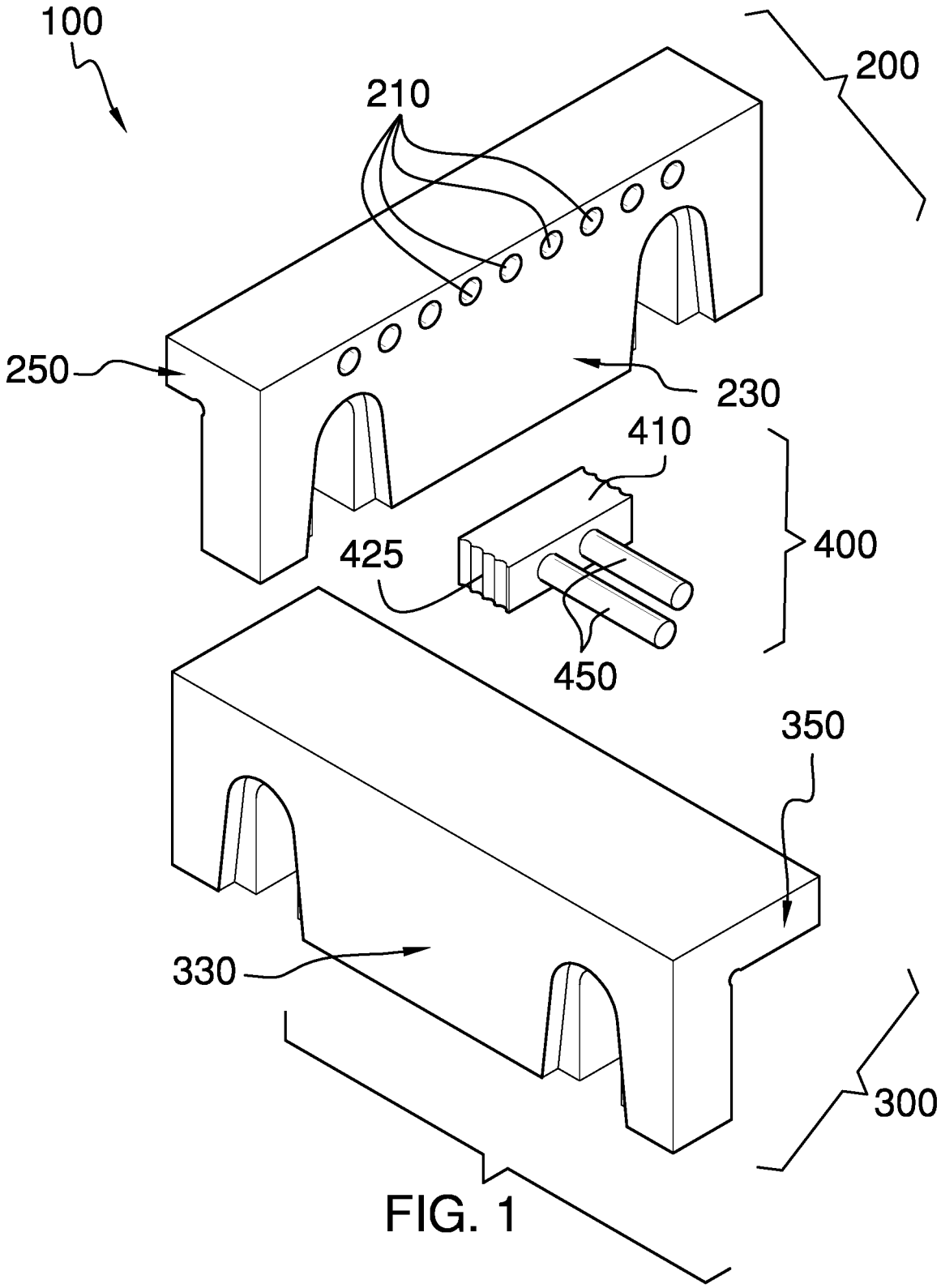
FIG. 1 is a perspective view of an embodiment of the disclosure.
Figure 2:
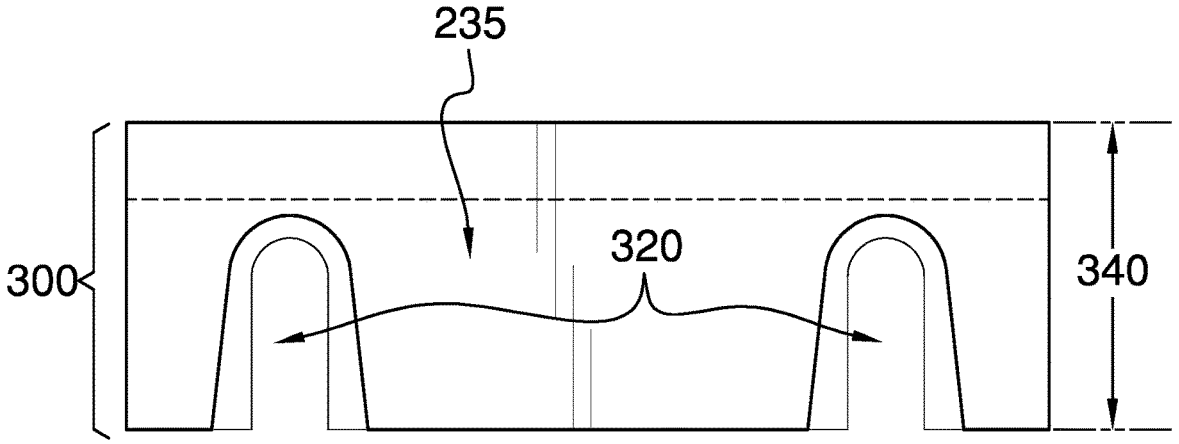
FIG. 2 is a front view of the movable jaw plate according to an embodiment of the disclosure.
Figure 3:
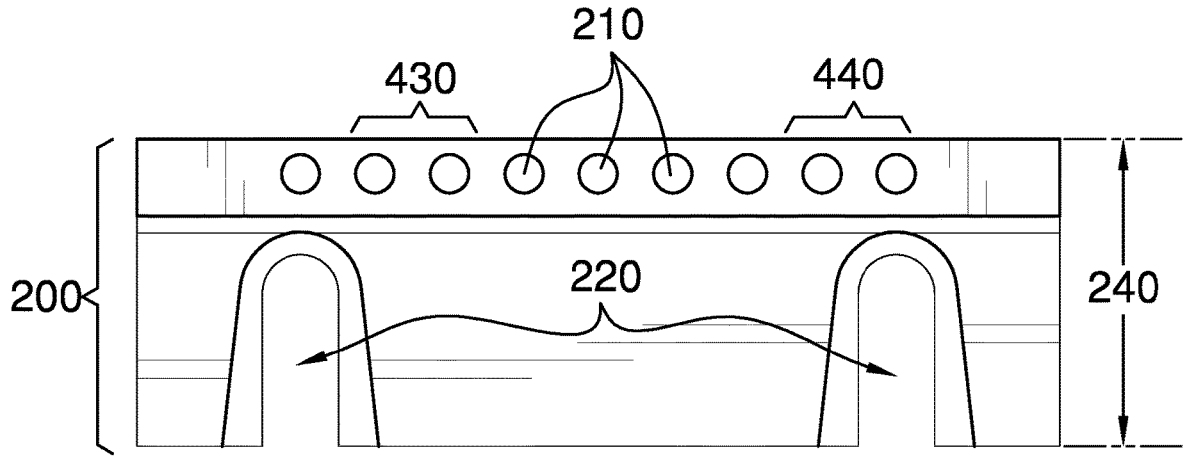
FIG. 3 is a rear view of the stationary jaw plate according to an embodiment of the disclosure.
Figure 4:
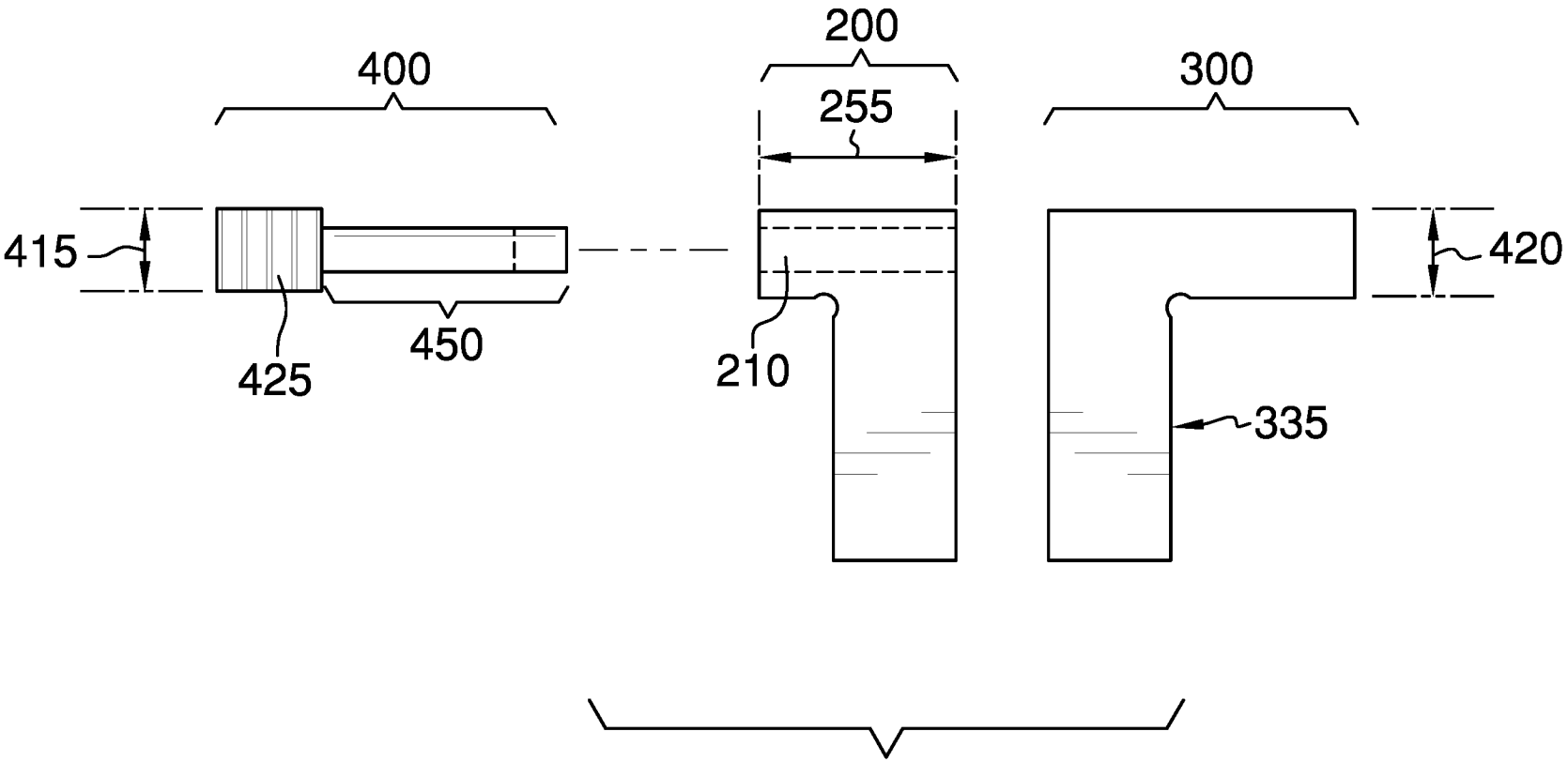
FIG. 4 is a side view of an embodiment of the disclosure.
Figure 5:
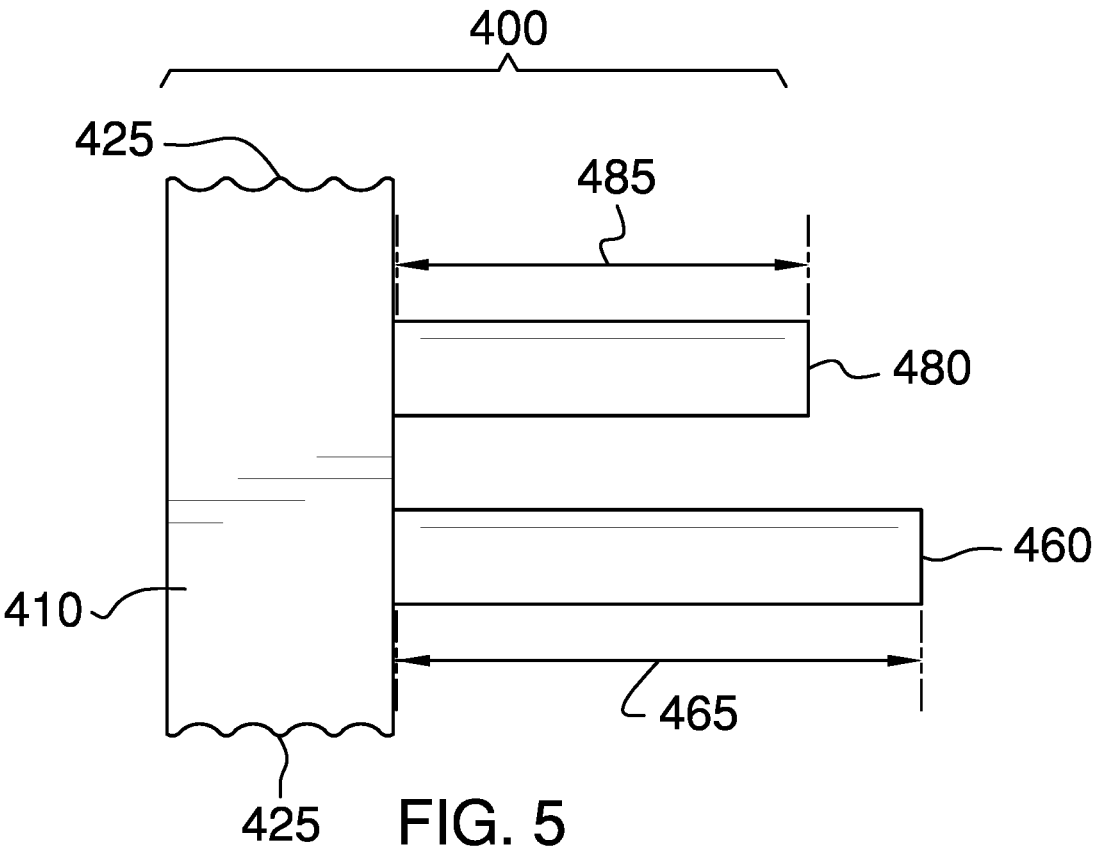
FIG. 5 is a top view of the stop block according to an embodiment of the disclosure.
Figure 6:
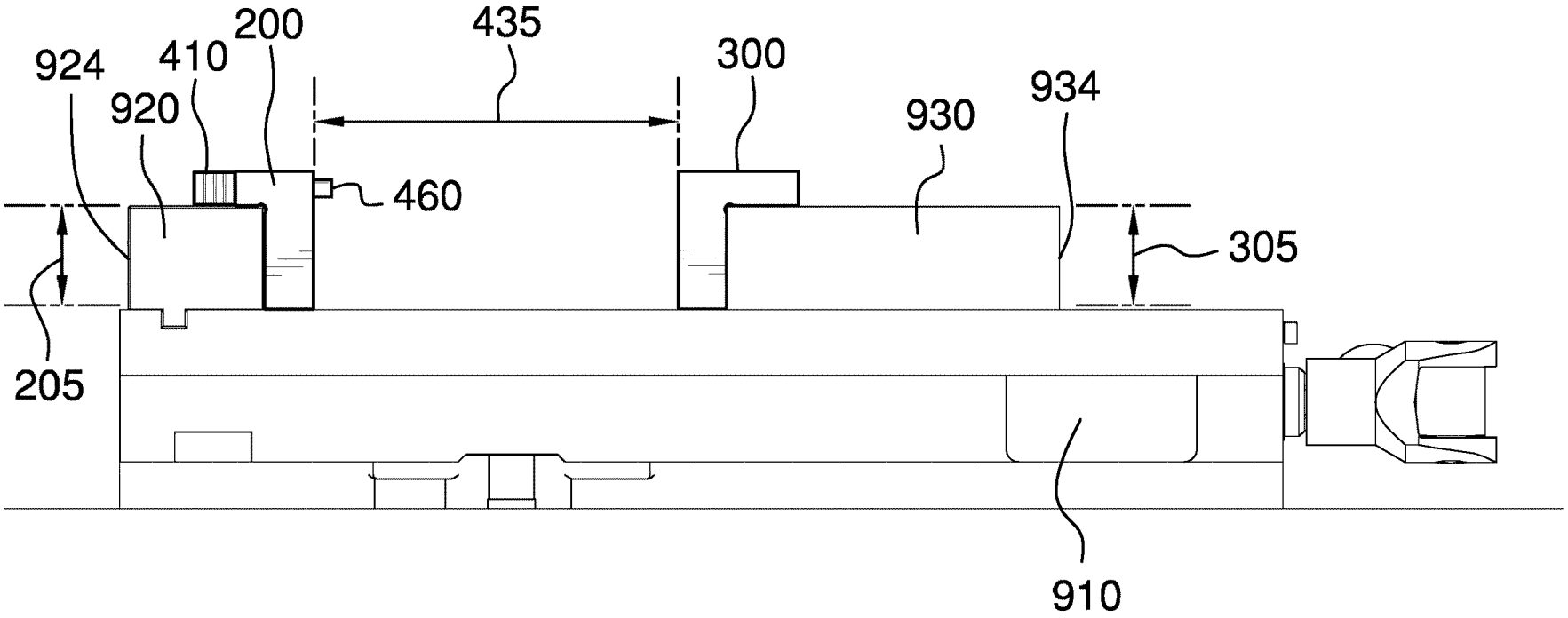
FIG. 6 is a side view of an embodiment of the disclosure while in use with both jaw plates attached to inside faces of the vise jaws.
Figure 7:
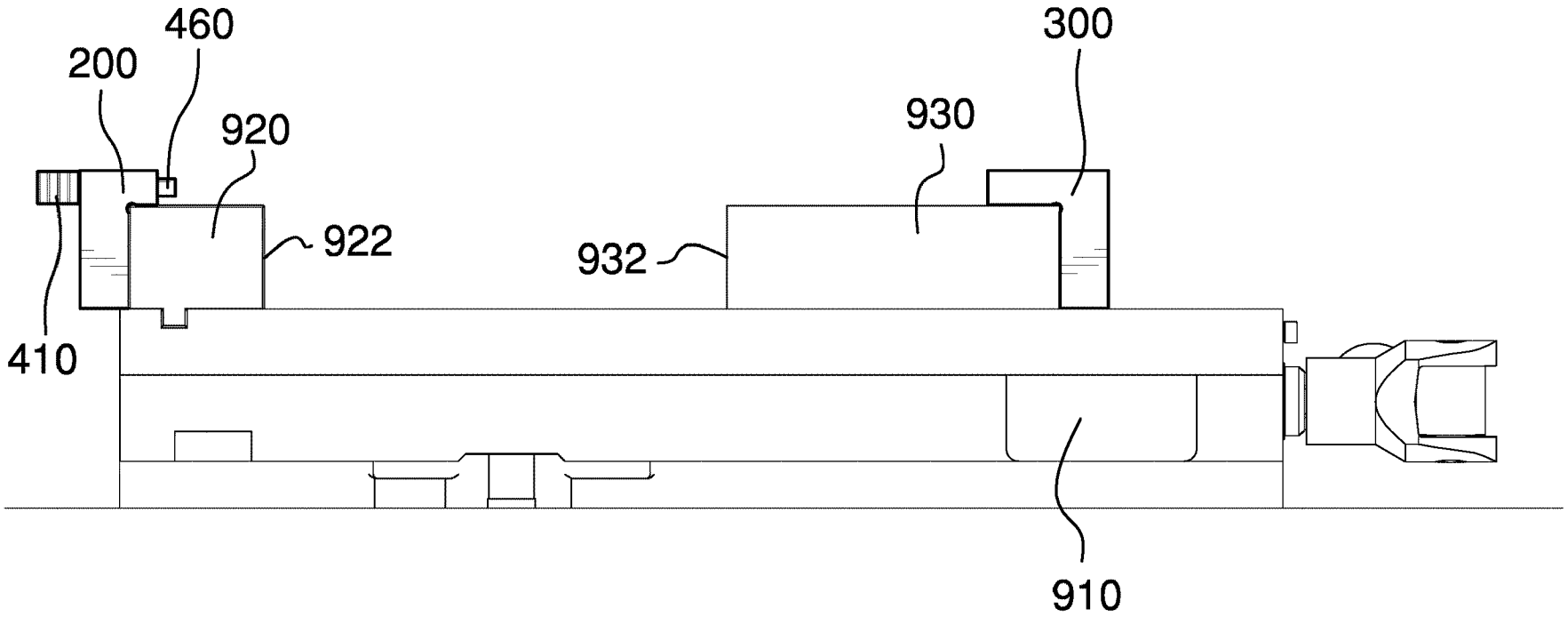
FIG. 7 is a side view of an embodiment of the disclosure while in use with both jaw plates attached to outside faces of the vise jaws.
Figure 8:
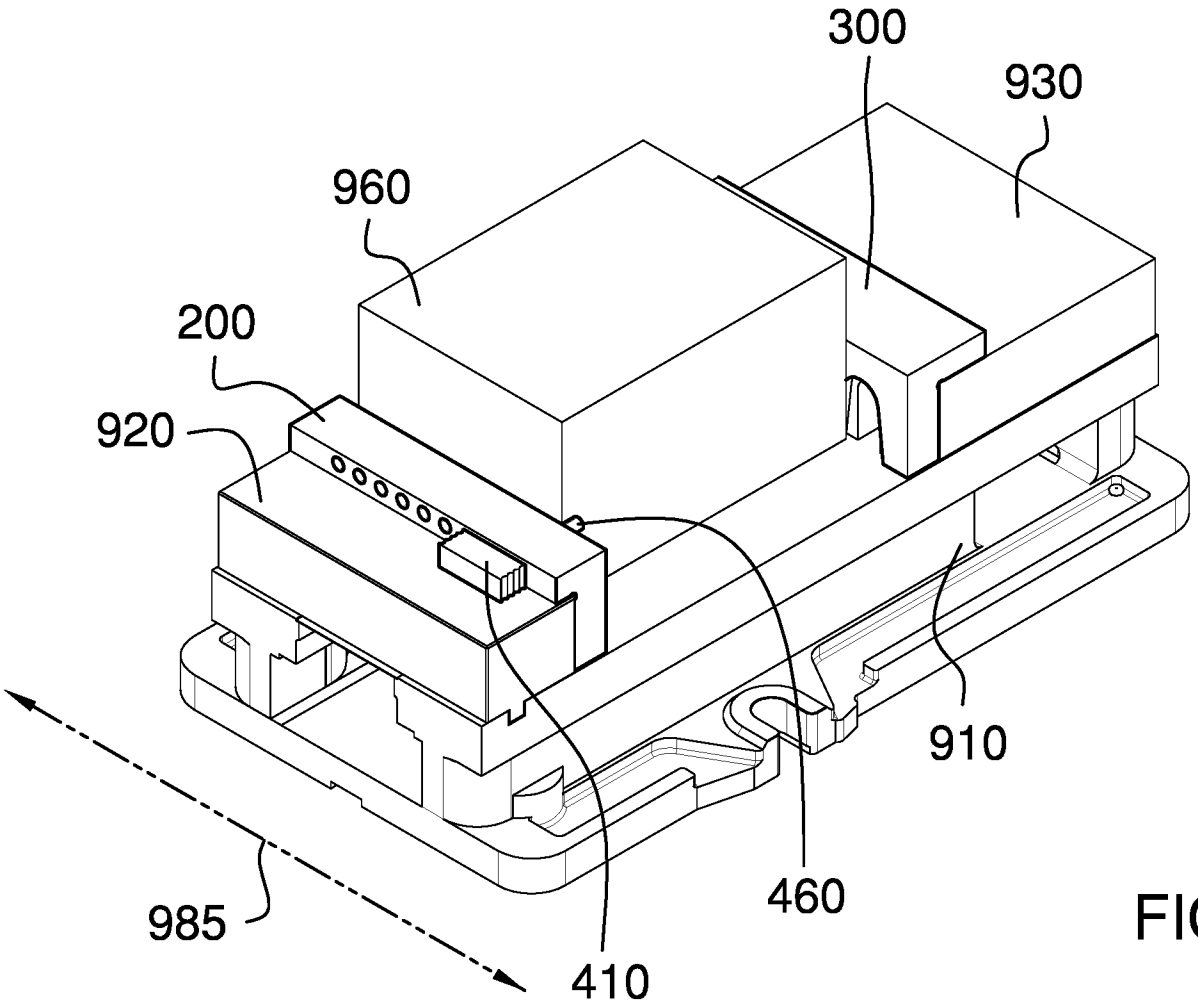
FIG. 8 is a perspective view of an embodiment of the disclosure while in use showing the orientation of the X-axis.

Detailed reference will now be made to a first potential embodiment of the disclosure, which is illustrated in FIGS. 1 through 8.

The tool-less vise jaw system 100 (hereinafter invention) comprises a stop block 400, a stationary jaw plate 200, and a movable jaw plate 300. The invention 100 attaches to a vise 910 on a milling machine (not illustrated in the figures) and allows an operator (not illustrated in the figures) of the milling machine to transition between jobs without having to edge find.

The stop block 400 comprises a handle 410 and a pair of pins 450. The handle 410 may be used to grasp the stop block 400 when the stop block 400 is being moved. A height of the handle 415 may match a height of the overhangs 420 so that the stop block 400 does not extend above the stationary jaw plate 200. Both lateral sides 425 of the handle 410 may be textured to improve handling of the stop block 400.

The pair of pins 450 comprises a long pin 460 and a short pin 480. The long pin 460 and the short pin 480 may be parallel to each other and the pair of pins 450 may extend horizontally from the same end of the handle 410. The spacing between the long pin 460 and the short pin 480 may match the spacing of a plurality of stop holes 210. A length of the short pin 485 may be less than or equal to a thickness of the stationary jaw plate overhang 255 so that the short pin 480 does not extend out of a stationary jaw plate overhang 250. A length of the long pin 465 may be greater than the thickness of the stationary jaw plate overhang 255 so that the long pin 460 extends out of the stationary jaw plate overhang 250.

The stop block 400 may be inserted into a first set of adjacent holes 430 selected from the plurality of stop holes 210 such that the long pin 460 extends into a space between the stationary jaw plate and the movable jaw plate 435. A digital readout (not illustrated in the figures) may then be calibrated using the long pin 460 as a reference point for an X-axis 985 position of a first workpiece (not illustrated in the figures).

The stop block 400 may be moved to a second set of adjacent holes 440 in the stationary jaw plate 200 in preparation for a second workpiece (not illustrated in the figures) where the first workpiece and the second workpiece are different sizes. After moving the stop block 400, the digital readout may be programmed to change an X-axis offset by a distance corresponding to the distance that the long pin 460 has been moved, thus avoiding having to edge find before working on the second workpiece.

If necessary, the stop block 400 may be symmetrical and may be flipped over to allow the long pin 460 to enter all of the plurality of stop holes 210, including the holes on both ends of the plurality of stop holes 210.

The stationary jaw plate 200 may be an L-shaped, metal plate. The stationary jaw plate 200 may couple to a stationary jaw 920 of the vise 910 on the milling machine. The stationary jaw plate 200 may mount to either a stationary jaw inside face 922 or to a stationary jaw outside face 924.

The stationary jaw plate 200 may comprise a first pair of mounting holes 220. The first pair of mounting holes 220 may be slotted in a vertical direction to allow attachment of the stationary jaw plate 200 to a number of different types of vises, which may have mounting holes at different heights. A stationary jaw plate front face 230 and a stationary jaw plate rear face 235 may be counterbored to allow mounting bolts to seat below the surface of the stationary jaw plate 200. The stationary jaw plate 200 may couple to the stationary jaw 920 by passing mounting bolts (not illustrated in the figures) through the first pair of mounting holes 220 from the stationary jaw plate front face 230 and into mounting holes on the stationary jaw 920 (not illustrated in the figures). The stationary jaw plate 200 may comprise the stationary jaw plate overhang 250, which extends over the top of the stationary jaw 920 when the stationary jaw plate 200 is coupled to the stationary jaw 920.

A stationary jaw plate height 240, as measured on the stationary jaw plate front face 230, may be larger than a stationary jaw height 205. The height of the stationary jaw plate rear face 235 may match the stationary jaw height 205. Because the stationary jaw plate 200 increases the height of the stationary jaw 920, the invention 100 allows the vise 910 to accommodate a workpiece 960 that nests deeper into the vise 910 than would be possible without the invention 100.

The stationary jaw plate 200 may comprise the plurality of stop holes 210. The plurality of stop holes 210 may be equally spaced in a horizontal direction across the stationary jaw plate front face 230. As a non-limiting examples, the plurality of stop holes 210 may be spaced on ½ inch centers. The plurality of stop holes 210 may extend horizontally all the way through the stationary jaw plate 200, exiting through the stationary jaw plate overhang 250. The plurality of stop holes 210 are centered vertically relative to the stationary jaw plate overhang 250.

The movable jaw plate 300 may be an L-shaped, metal plate. The movable jaw plate 300 may couple to a movable jaw 930 of the vise 910 on the milling machine. The movable jaw plate 300 may mount to either a movable jaw inside face 932 or to a movable jaw outside face 934.

The movable jaw plate 300 may comprise a second pair of mounting holes 320. The second pair of mounting holes 320 may be slotted in a vertical direction to allow attachment of the movable jaw plate 300 to a number of different types of vises, which may have mounting holes at different heights. A movable jaw plate front face 330 and a movable jaw plate rear face 335 may be counterbored to allow mounting bolts to seat below the surface of the movable jaw plate 300. The movable jaw plate 300 may couple to the movable jaw 930 by passing mounting bolts (not illustrated in the figures) through the second pair of mounting holes 320 from the movable jaw plate front face 330 and into mounting holes on the movable jaw 930 (not illustrated in the figures). The movable jaw plate 300 may comprise a movable jaw plate overhang 350, which extends over the top of the movable jaw 930 when the movable jaw plate 300 is coupled to the movable jaw 930. The height of the overhangs 420 may be the same for both the stationary jaw plate overhang 250 and the movable jaw plate overhang 350.

A movable jaw plate height 340, as measured on the movable jaw plate front face 330, may be larger than a movable jaw height 305. The height of the movable jaw plate rear face 335 may match the movable jaw height 305. Because the movable jaw plate 300 increases the height of the movable jaw 930, the invention 100 allows the vise 910 to accommodate the workpiece 960 that nests deeper into the vise 910 than would be possible without the invention 100.

In use, the stop block 400 may be inserted into the first set of adjacent holes 430 selected from the plurality of stop holes 210 such that the long pin 460 extends into the space between the stationary jaw plate and the movable jaw plate 435. The digital readout may then be calibrated using the long pin 460 as a reference point for the X-axis 985 position of the first workpiece. The first workpiece may be placed into the vise 910 and positioned against the long pin 460, the vise 910 may be tightened to hold the first workpiece in place, and the first workpiece may be processed and removed from the vise 910. After completing work on the first workpiece, the stop block 400 may be moved to the second set of adjacent holes 440 in the stationary jaw plate 200 in preparation for the second workpiece where the first workpiece and the second workpiece are different sizes. After moving the stop block 400, the digital readout may be programmed to change the X-axis offset by a distance corresponding to the distance between the first set of adjacent holes 430 and the second set of adjacent holes 440, thus avoiding having to edge find before working on the second workpiece. The second workpiece may be placed into the vise 910 and positioned against the long pin 460, the vise 910 may be tightened to hold the second workpiece in place, and the second workpiece may be processed and removed from the vise 910.

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used herein, "counterbore" refers to a flat-bottomed hole that enlarges another hole in a part. A counterbored hole may be used to allow the head of a bolt to sit flush with or below a part's surface. Counterbored holes are often cylindrical and coaxial with the hole that they enlarge.

As used herein, the words "couple", "couples", "coupled" or "coupling", mean connected, either directly or indirectly and does not necessarily imply a mechanical connection.

As used herein, a "digital position readout", "digital readout", or "DRO" is a piece of equipment that provides a numerical position display showing the position of parts of an industrial machine or tool. On a milling machine a 3-axis DRO shows the X— and Y— positions of the mill table plus the Z-axis position of the cutting tool.

As used here, to "edge find" or "edge finding" is a process used during the calibration of a tool such as a milling machine. The process typically involves moving the tool into a known physical position along one or more axes and adjusting a digital readout (DRO) to show a zero reading.

As used herein, "front" means the side of an object that is closest to a forward direction of travel under normal use of the object or the side or part of an object that normally presents itself to view or that is normally used first. "Rear" or "back" refers to the side that is opposite the front.

As used in this disclosure, a "handle" is an object by which a tool, object, or door is held or manipulated with the hand.

As used in this disclosure, "horizontal" is a directional term that refers to a direction that is perpendicular to the local force of gravity. Unless specifically noted in this disclosure, the horizontal direction is always perpendicular to the vertical direction.

As used in this disclosure, the word "lateral" refers to the sides of an object or movement towards a side. Lateral directions are generally perpendicular to longitudinal directions.

As used herein, the term "nest" refers to a positional relationship between a workpiece and the vise, tool, or machine upon which the workpiece is mounted. Specifically, a nested workpiece has a flange or other lateral enlargement that rests on a top surface of a vise, tool, or machine while another portion of the workpiece extends downwards into the vise, tool, or machine.

As used in this disclosure, a "plate" is a smooth, flat and rigid object having at least one dimension that is of uniform thickness and appears thinner than the other dimensions of the object. Plates often have a rectangular or disk like appearance. Plates may be made of any material, but are commonly made of metal.

As used in this disclosure, "vertical" refers to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 8, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A vise jaw system comprising:
- a stop block, a stationary jaw plate, and a movable jaw plate;
- wherein the vise jaw system attaches to a vise on a milling machine and is adapted to allow an operator of the milling machine to transition between jobs without having to edge find;
- wherein the stop block comprises a handle and a pair of pins;
- wherein the handle is used to grasp the stop block when the stop block is being moved;
- wherein a height of the handle matches a height of the overhangs so that the stop block does not extend above the stationary jaw plate;
- wherein the pair of pins comprises a long pin and a short pin;
- wherein the long pin and the short pin are parallel to each other and the pair of pins extend horizontally from the same end of the handle;
- wherein the spacing between the long pin and the short pin matches the spacing of a plurality of stop holes;
- wherein a length of the short pin is less than or equal to a thickness of the stationary jaw plate overhang so that the short pin does not extend out of a stationary jaw plate overhang;
- wherein a length of the long pin is greater than the thickness of the stationary jaw plate overhang so that the long pin extends out of the stationary jaw plate overhang.

2. The vise jaw system according to claim 1
- wherein both lateral sides of the handle are textured to improve handling of the stop block.

3. The vise jaw system according to claim 1
- wherein the stop block is inserted into a first set of adjacent holes selected from the plurality of stop holes such that the long pin extends into a space between the stationary jaw plate and the movable jaw plate;
- wherein a digital readout is calibrated using the long pin as a reference point for an X-axis position of a first workpiece.

4. The vise jaw system according to claim 3
- wherein the stop block is moved to a second set of adjacent holes in the stationary jaw plate in preparation for a second workpiece where the first workpiece and the second workpiece are different sizes;
- wherein after moving the stop block, the digital readout is programmed to change an X-axis offset by a distance corresponding to the distance that the long pin has been moved, thus avoiding having to edge find before working on the second workpiece.

5. The vise jaw system according to claim 4 wherein the stop block is symmetrical and is flipped over to allow the long pin to enter all of the plurality of stop holes, including the holes on both ends of the plurality of stop holes.

6. The vise jaw system according to claim 5 wherein the stationary jaw plate is an L-shaped, metal plate;

wherein the stationary jaw plate couples to a stationary jaw of the vise on the milling machine;

wherein the stationary jaw plate mounts to either a stationary jaw inside face or a stationary jaw outside face.

7. The vise jaw system according to claim 6 wherein the stationary jaw plate comprises a first pair of mounting holes;

wherein the first pair of mounting holes are slotted in a vertical direction to allow attachment of the stationary jaw plate to a number of different types of vises which have mounting holes at different heights;

wherein the stationary jaw plate couple to the stationary jaw by passing mounting bolts through the first pair of mounting holes from a stationary jaw plate front face and into mounting holes on the stationary jaw;

wherein the stationary jaw plate comprises the stationary jaw plate overhang which extends over the top of the stationary jaw when the stationary jaw plate is coupled to the stationary jaw.

8. The vise jaw system according to claim 7 wherein the stationary jaw plate front face and a stationary jaw plate rear face is counterbored to allow the mounting bolts to seat below the surface of the stationary jaw plate.

9. The vise jaw system according to claim 7 wherein a stationary jaw plate height is larger than a stationary jaw height;

wherein the height of the stationary jaw plate rear face matches the stationary jaw height;

wherein the to vise jaw system allows the vise to accommodate a workpiece that nests deeper into the vise than would be possible without the vise jaw system.

10. The vise jaw system according to claim 9 wherein the stationary jaw plate comprises the plurality of stop holes;

wherein the plurality of stop holes are equally spaced in a horizontal direction across the stationary jaw plate front face.

11. The vise jaw system according to claim 10 wherein the plurality of stop holes are spaced on ½ inch centers.

12. The vise jaw system according to claim 10 wherein the plurality of stop holes extend horizontally all the way through the stationary jaw plate, exiting through the stationary jaw plate overhang;

wherein the plurality of stop holes are centered vertically relative to the stationary jaw plate overhang.

13. The vise jaw system according to claim 12 wherein the movable jaw plate is an L-shaped, metal plate;

wherein the movable jaw plate couples to a movable jaw of the vise on the milling machine;

wherein the movable jaw plate mounts to either a movable jaw inside face or to a movable jaw outside face.

14. The vise jaw system according to claim 13 wherein the movable jaw plate comprises a second pair of mounting holes;

wherein the second pair of mounting holes are slotted in a vertical direction to allow attachment of the movable jaw plate to a number of different types of vises which have mounting holes at different heights;

wherein the movable jaw plate couples to the movable jaw by passing mounting bolts through the second pair of mounting holes from a movable jaw plate front face and into mounting holes on the movable jaw;

wherein the movable jaw plate comprises a movable jaw plate overhang which extends over the top of the movable jaw when the movable jaw plate is coupled to the movable jaw.

15. The vise jaw system according to claim 14 wherein the movable jaw plate front face and a movable jaw plate rear face are counterbored to allow the mounting bolts to seat below the surface of the movable jaw plate.

16. The vise jaw system according to claim 14 wherein the height of the overhangs is the same for both the stationary jaw plate overhang and the movable jaw plate overhang.

17. The vise jaw system according to claim 16 wherein a movable jaw plate height is larger than a movable jaw height;

wherein the height of the movable jaw plate rear face matches the movable jaw height.

* * * * *